US007789581B2

(12) United States Patent
Heidenreiter

(10) Patent No.: US 7,789,581 B2
(45) Date of Patent: Sep. 7, 2010

(54) APPLICATOR DEVICES WITH A SHORT TWIST-OFF PROTECTIVE CAP

(75) Inventor: Thomas Heidenreiter, Kalchreuth (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 1026 days.

(21) Appl. No.: 11/473,807

(22) Filed: Jun. 22, 2006

(65) Prior Publication Data

US 2007/0034222 A1 Feb. 15, 2007

(30) Foreign Application Priority Data

Jun. 22, 2005 (DE) ..... 20 2005 009 819 U

(51) Int. Cl.
*B43K 21/08* (2006.01)

(52) U.S. Cl. ..... 401/76; 401/75; 401/98

(58) Field of Classification Search ..... 401/68, 401/75–78, 98, 171–173
See application file for complete search history.

(56) References Cited

U.S. PATENT DOCUMENTS 4,363,560 A * 12/1982 Gentile ..... 401/68
5,000,600 A * 3/1991 Cardia et al. ..... 401/75
5,018,892 A 5/1991 Krueckel et al.
5,366,311 A 11/1994 Powers
5,423,623 A 6/1995 Bakic
5,879,093 A 3/1999 Ohba et al.
6,068,421 A 5/2000 Pierpont
6,082,917 A 7/2000 Noguchi et al.
6,293,720 B1 9/2001 Zahn
6,451,927 B1 9/2002 Haas et al.
6,773,190 B2 * 8/2004 Matsumoto et al. ..... 401/194
2002/0014254 A1 2/2002 Gueret

FOREIGN PATENT DOCUMENTS

JP 11139470 5/1999
JP 11187929 7/1999

* cited by examiner

*Primary Examiner*—David J Walczak
(74) *Attorney, Agent, or Firm*—Bachman & LaPointe, P.C.

(57) ABSTRACT

An applicator device for applying a material in the form of a lead, in particular for applying a cosmetic material, comprising a holding part, in the interior of which the lead material (KM) to be applied is accommodated and which has an exit opening for the lead material (KM), a rotary part into which the holding part is preferably telescopically fitted and which is axially fixedly but rotatably connected to the holding part at a coupling portion thereof by way of a counterpart coupling portion provided at the rotary part, a rotary mechanism for axial displacement of the lead material (KM).

16 Claims, 4 Drawing Sheets

APPLICATOR DEVICES WITH A SHORT TWIST-OFF PROTECTIVE CAP

BACKGROUND OF THE INVENTION

The present invention concerns an applicator device for applying a material in the form of a lead, in particular for applying a cosmetic material.

Applicator devices for cosmetic preparations in pencil form, preferably with a rotary mechanism, in which the lead material is introduced into a front or holding part of that rotary mechanism and therein can be axially screwed out or even twisted forward and back are well-known. By way of example mention may be made here of German laid-open applications Nos. 32 15 215 and 198 51 219, German patents Nos. 37 28 427, 38 35 679 and 44 45 230 and U.S. Pat. Nos. 5,366,311 and 5,364,197.

In all cases the applicator device is in the form of a more or less regularly shaped cylinder. In that arrangement the holding part must be of a sufficiently long dimension as the lead material to be applied is disposed therein. In general disposed in the rear portion or rotary portion of the applicator device is a screwthreaded spindle which is arranged non-rotatably but axially movably and which co-operates with a screwthread portion on the holding part and thus provides for the forward drive of the lead material.

The lead material comprises a more or less soft cosmetic material which can be easily transferred on to the human skin and so forth. Such a lead material and in particular a cast lead material is therefore never a rigid body but is always a thixotropic preparation which is deformed or even liquefied under the effect of pressing or shearing forces. Accordingly an intermediate element is required between the screwthreaded spindle and the lead material, which converts the relative rotary movement of the spindle in the region of the screwthread portion in the holding part into an exclusively axial movement. Known in that respect are thrust elements or lead holders which are rigidly connected to the lead and which co-operate with the screwthreaded spindle for example by way of a ball joint.

That arrangement which is known from the state of the art now means that the rotary part must now also be of a sufficiently long dimension as it firstly must accommodate a screwthreaded spindle with a 'nett length' which is sufficient for the lead in the course of use to be conveyed as completely as possible out of the holding part. In addition however a fixing element must be provided at the rear end of the rotary spindle, the fixing element co-operating with corresponding means in the interior of the rotary part in order to prevent rotational movement of the screwthreaded spindle. Not least the screwthreaded spindle must contain the above-described intermediate element and the ball joint or another suitable means. The addition of those above-mentioned sub-components thus results in the applicator device being of a considerable overall length, as can be seen for example from U.S. Pat. Nos. 5,366,311 and 5,364,197 which have already been mentioned above.

The above-mentioned applicator devices are very often used in the area of 'liners', such as for example lipliners, eyeliners, eyebrow pencils or concealer pencils which are to be applied in point form. Such 'liners' usually involve lead diameters in the region of 2 to 5 mm with a usable length for the lead in the region of 35 to 60 mm. This means that applicator devices of the specified kind are of substantially different dimensions (and thus also involve substantially different handling problems) from conventional lipsticks involving lead diameters in the region between 10 and 15 mm and lead lengths of between 35 and 45 mm. In comparison with 'liners' lipsticks are short and stocky.

To protect the tip of the lead pencil from contamination and damage when not in use, the holding part is covered by a protective cap which is releasably fitted thereon, referred to as a 'protector member', which is usually fitted on over the holding part and fixed on the rotary part by means of a clamping fit. Usually—not least to facilitate removal of the holding part from the mould of the injection moulding tool—the clamping region between the holding part and the protector member is at least partially in the form of a cone portion. If the lead material contains volatile constituents such as for example volatile silicone oils or isoparaffins in order to impart as long durability as possible on the skin to the lead materials and to prevent the lead materials from migrating from the location of application thereof for as long as possible, provision is to be made for a good seal between the holding part and the protector member so that the clamping fit is of a correspondingly tight nature. In addition latching means can also be provided, in the form of co-operating annular grooves or annular ridges. Fitting the protector member on to the rotary part and thus completely covering over the holding part by the protector member ensures at the same time that the rotary mechanism is not actuated when the protector member is fitted in position and the lead material thus cannot be damaged by unintentional actuation. Accordingly the protector member is of a correspondingly large axial length.

U.S. Pat. No. 5,366,311 which has already been referred to hereinbefore and which forms the most relevant state of the art and which the present invention takes as its basic starting point provides that the holding part, the rotary part and the protector member are of a very small diameter and are of approximately the same axial length, wherein the holding part and the rotary part each form approximately half the length of the applicator device. A disadvantage with an applicator device of that kind is that the protector member has to be pulled off the rotary part, by applying some force. By virtue of its length, it can be easily radially deflected as it is being pulled off and in that situation can tilt, which can result in unintentional damage to the tip of the lead. In addition a long, thin, cylindrical body is difficult to grip, in particular when a lady user has already put cream on her face or hands.

The object of the present invention is to provide an applicator device of the kind set forth in the opening part of this specification, which minimises the tendency to tilting when the protector member is pulled off the rotary part and thus minimises the risk of damage to the tip of the lead. A further object of the present invention is that of continuously building up the necessary removal forces in order to reduce the risk of tearing off the protector member with subsequent tilting, causing damage to the tip of the lead material.

SUMMARY OF THE INVENTION

The foregoing object is attained by providing an applicator device for applying a material in the form of a lead, comprising a holding part, in the interior of which the lead material (KM) to be applied is accommodated and which has an exit opening for the lead material (KM), a rotary part into which the holding part is preferably telescopically fitted and which is axially fixedly but rotatably connected to the holding part at a coupling portion thereof by way of a counterpart coupling portion provided at the rotary part, a rotary mechanism for axial displacement of the lead material (KM), the mechanism being arranged in the rotary part, and a protector member for covering the exit opening, wherein the protector member has a fitting opening at its one end and is closed at its other end and wherein the protector member can be reversibly fitted on to the rotary part, characterised in that the axially fixed, rotatable connection between the coupling portion of the holding part and the counterpart coupling portion of the rotary part is made in a region which extends from the exit opening of the holding part by a maximum of ⅓ of the axial length of the holding part on the holding part.

Arranging the coupling portion of the holding part and the counterpart coupling portion of the rotary part to form the axially fixed, rotatable connection between the coupling portion and the counterpart coupling portion in a region which extends from the exit opening of the holding part by a maximum of ⅓ of the axial length of the holding part on the holding part provides that only a comparatively small portion of the holding part still projects out of the rotary part. As the protector member extends as far as the coupling portion of the rotary part, that makes it possible for the protector member to be only of a comparatively short axial length. That avoids the risk that tilting of the protector member with respect to the holding part occurs when pulling off or putting on that protector member. In addition the rotary part can be securely gripped when pulling off the protector member by virtue of its axial length being markedly greater in comparison with the applicator device known from U.S. Pat. No. 5,366,311.

In that respect the axial length of the holding part may be shorter than the axial length of the rotary part. Furthermore the axial length of the protector member may be shorter than the axial length of the holding part. In addition the axial length of the protector member may be shorter than the axial length of the rotary part.

A particularly advantageous configuration of the protector member can be achieved if the ratio of the overall length $L_A$ of the applicator device to the length $L_S$ of the protector member is in a range of between 2.5 and 5.5, preferably in a range of between 3 and 4.2 and particularly preferably in a range of between 3.3 and 3.7. It is further advantageous if the ratio of the length $L_S$ of the protector member to its diameter $D_S$ is in a range of between 2.5 and 5.5, preferably in a range of between 3 and 4.2 and particularly preferably in a range of between 3.3 and 3.7.

In use, that is to say when the protector member has been removed, the applicator device should be in a good balanced condition in the hand of the lady user in order in that way to permit an accurate line to be drawn. In the case of the applicator device known from U.S. Pat. No. 5,366,311 the centre of gravity $X_S$ is approximately in the region of the centre of the applicator device with the protector member fitted. As stated above the diameters of the leads in the applicator device according to the invention are in a range of between 2 and 5 mm and their length is in a range of between 35 and 60 mm. Leads with such an unfavourable ratio between length and diameter are extremely at risk of breakage, in particular when they involve an even only minimum air gap between the exterior of the lead and the inside wall of the holding part. Appropriate tests with applicator devices of that kind have shown that lead materials break particularly easily when those applicator devices, upon being dropped, impact against the floor or an object more or less horizontally with respect to the longitudinal axis. It has therefore been found to be particularly advantageous to select a configuration for the applicator device, in which the centre of gravity $X_S$ of the applicator device is in a region which extends from the exit opening of the holding part to less than half the overall length $L_A$ of the applicator device. In other words the centre of gravity $X_S$ of the applicator device is oriented more closely towards the side of the applicator device, which carries the protector member. The following relationship therefore applies when the protector member is fitted in place: $X_S<L_A/2$. Preferably the centre of gravity $X_S$, when the protector member is removed, is so positioned that it is at least approximately at the centre of the longitudinal extent of the applicator device, that is to say the following applies: $X_S=L/2$, wherein L denotes the length of the applicator device without the protector member. The applicator device according to the invention is therefore advantageously nose-heavy.

If now the applicator device according to the invention is not in the form of a cylindrical body—corresponding to the examples from the state of the art—but is of such a configuration that it therefore forms a cone portion, the diameter of which decreases at least portion-wise and more or less continuously from the closed end of the protector member to the rear end of the applicator device, then that nose-heaviness can be still positively increased.

The above-discussed configuration of the applicator device according to the invention, in regard to the centre of gravity, can also be used independently of the ideas of the invention which have been discussed hereinbefore in connection with the arrangement of the coupling portion and counterpart coupling portion respectively on the holding part and the axial lengths of the protector member, the rotary part and the holding part.

In order to be able to continuously build up the necessary removal forces for releasing the protector member from the rotary part, in accordance with the invention the open end of the protector member, which is towards the rotary part of the applicator device, is not flat and in a plane perpendicular to the longitudinal centre line but is at an angle $\alpha$ with respect to the longitudinal centre line which is less than 90°. If an abutment surface against which the protector member bears in the fitted condition thereof extends on the rotary part at an angle $\beta$ relative to the longitudinal centre line of the applicator device, which is also less than 90°, preferably equal to the angle $\alpha$, that provides that the counterpart mounting means on the rotary part is of a mirror-inverted nature. If now the protector member is rotated relative to the rotary part, that involves a sliding movement, comparable to an 'inclined plane', with a continuous build-up of force. As an alternative thereto the open end of the protector member can admittedly be perpendicular to the longitudinal axis, but of a sawtooth-like configuration—as a succession of a plurality of 'inclined planes'—or in the form of a sinusoidal wavy line with at least one raised portion and recess portion—. An embodiment with at least two raised portions and recess portions is more desirable in that respect. Instead of that sawtooth-like configuration the edge region can also be of a symmetrical configuration—as a succession of a plurality of 'inclined planes' each involving the same angle $\alpha$.

BRIEF DESCRIPTION OF THE DRAWINGS

Further advantageous configurations and an embodiment by way of example are described hereinafter with reference to the accompanying Figures. In this connection it is to be noted that the terms 'left', 'right', 'top' and 'bottom' used throughout the description relate to the Figures with the references in the normally readable condition. In the drawings.

DETAILED DESCRIPTION

Figure 1:
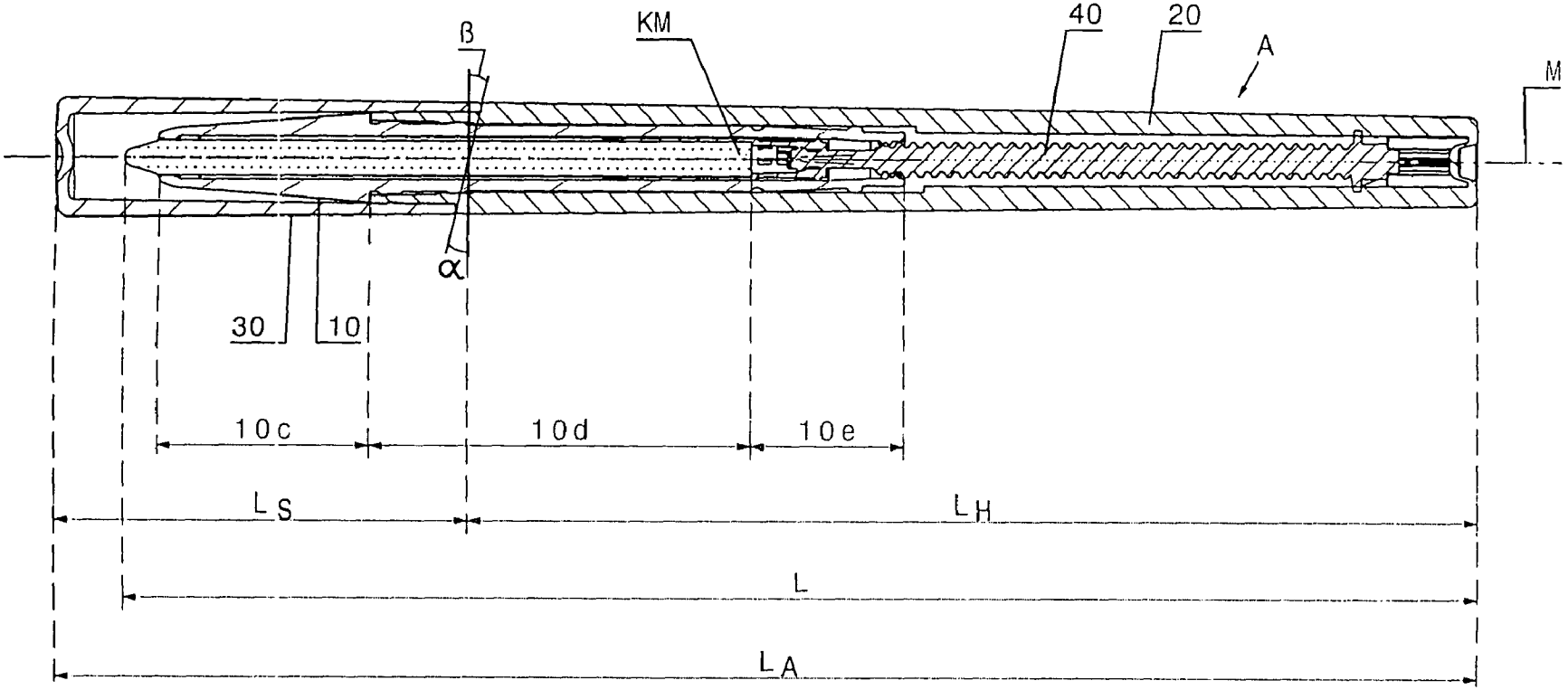
FIG. 1 is a view in longitudinal section through the applicator device according to the invention in the assembled condition.
Figure 2:
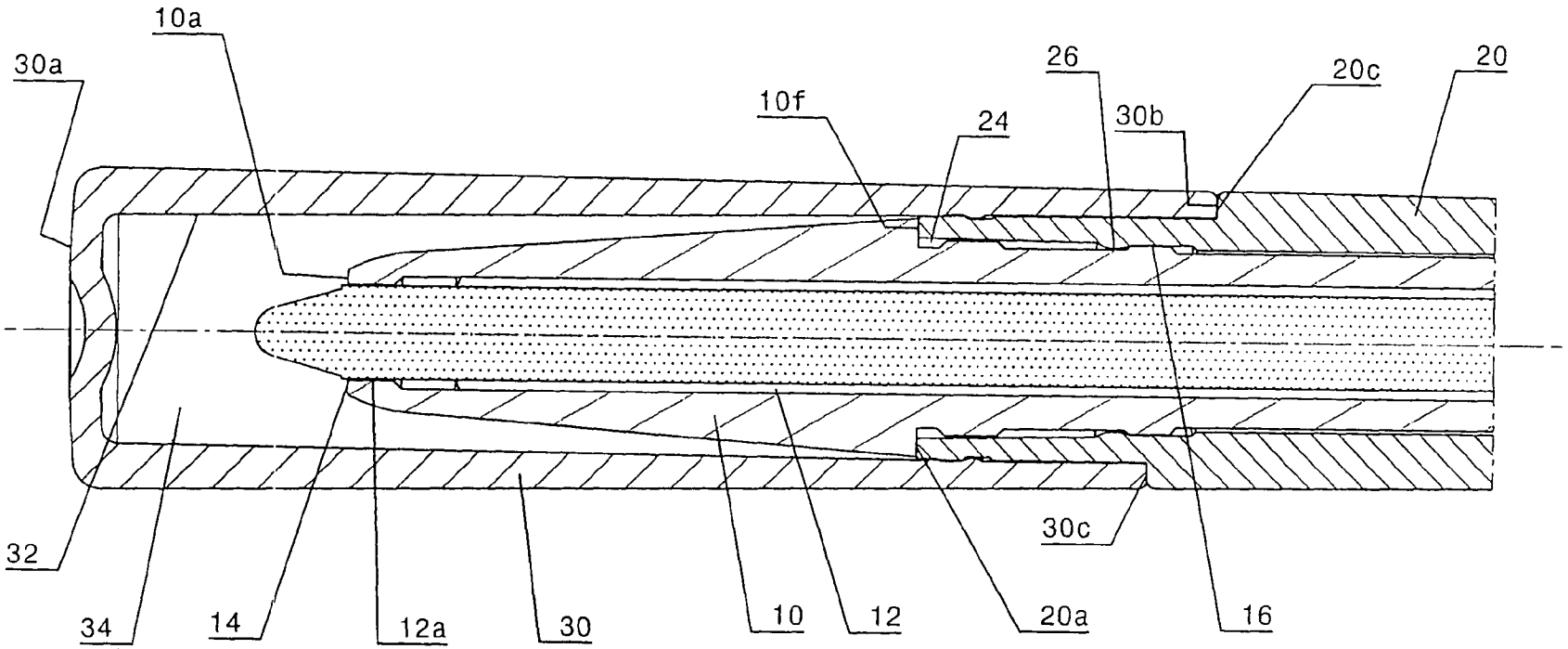
FIGS. 2 to 4 show individual portions of the longitudinal section in FIG. 1 on an enlarged scale.
Figure 3:
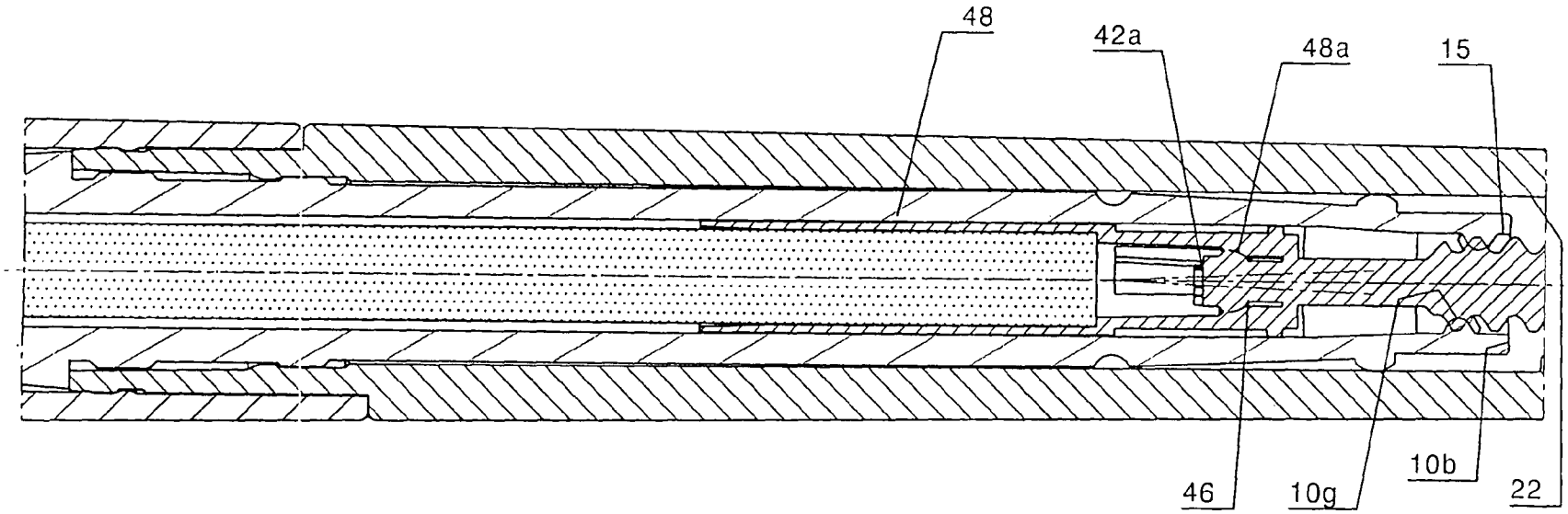
Figure 4:
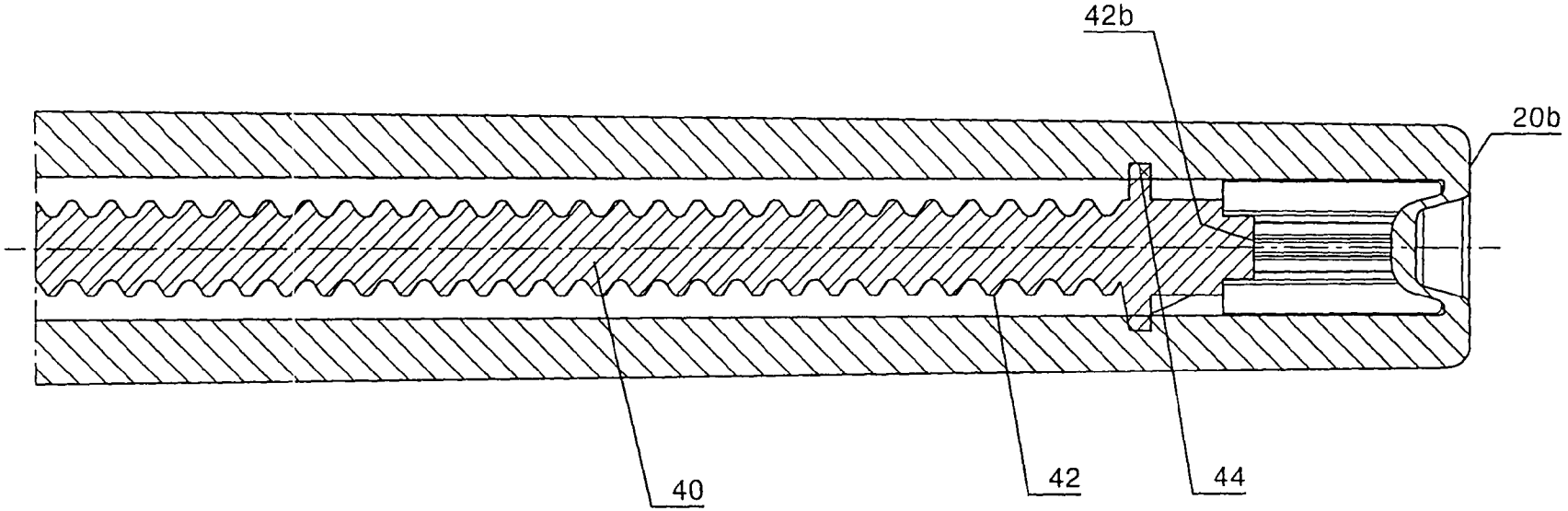

FIGS. 1 to 4 show the applicator device A according to the invention in the assembled condition in a longitudinal section. As essential components the applicator device A has a holding part 10, a rotary part 20, a protector member 30 and a rotary mechanism 40. The applicator device A also has a longitudinal axis M which in the assembled condition and when the protector member 30 is fitted on, extends in coaxial relationship with the longitudinal centre lines of the holding part 10, the rotary part 20, the protector member 30 and the rotary mechanism 40. In other words in the assembled condition of the applicator device A and with the protector member 30 fitted on, the longitudinal centre line M of the applicator device A is identical to the above-mentioned longitudinal centre lines.

The elongate holding part 10 which is made from plastic material and which is at least approximately cigar-shaped in its outside contour as will be described in greater detail hereinafter has in its interior a hollow space or cavity 12 which extends therethrough and which is parallel to the longitudinal centre line M and which is open at both ends. Except for the regions at the left-hand and right-hand ends 10*a*, 10*b* of the holding part 10 the cavity 12 is of a circular cross-section which remains the same throughout, with respect to the longitudinal centre line M.

A cosmetic lead material KM is axially displaceably arranged in the cavity 12. Except for its left-hand end (not identified in greater detail) the lead material KM is of a circular cross-section with respect to the longitudinal centre line M. At its left-hand end the lead material KM is provided with an application tip which is also not identified in greater detail. As can be seen from the Figure the outside diameter of the lead material KM except for the region at the left-hand end 10*a* of the holding part 10 is smaller than the inside diameter of the cavity 12 so that the lead material KM can be displaced in a direction in parallel relationship with the longitudinal centre line M in the cavity 12 without contact with the inside wall of the cavity 12. Depending on the respective purpose of use the lead diameter is 2 to 5 mm with a usable length of 35 to 60 mm.

At its left-hand end 10*a* the holding part 10 has an exit opening 14, by way of which the lead material KM can issue with its application tip formed thereon and during use is progressively advanced by means of the rotary mechanism 40. At the oppositely disposed right-hand end 10*b* the holding part 10 is provided with a coupling opening 15 in order to permit parts of the rotary mechanism 40 to pass therethrough, as is described in greater detail hereinafter. Furthermore at its left-hand end 10*a* the holding part 10 has an inwardly projecting guide portion 12*a* which is in the form of a circular cylindrical ring and the inside diameter of which at least approximately corresponds to the outside diameter of the lead material KM. That provides that the lead material KM is supported and guided when it issues from the exit opening 12.

The outside contour of the holding part 10 can be subdivided overall into three regions 10*c*, 10*d* and 10*e*. The first region 10*c* extends from the left-hand end 10*a* or the exit opening 12 towards the right in the direction of the right-hand end 10*b* and is in the shape of a truncated cone. In this case the outside diameter of the truncated cone increases from the left-hand end 10*a* uniformly to the end of the first region 10*c*. It is only at the left-hand end 10*a* that the truncated cone is rounded off.

The first region 10*c* of the outside contour of the holding part 10 ends at a shaft shoulder 10*f* at which the outside diameter of the holding part 10 decreases abruptly in the form of a step. The second region 10*d* of the holding part 10 extends from the shaft shoulder 10*f*. The second region 10*d* is at least approximately in the form of a cylinder. The second region 10*d* ends at two notches or indentations which are not identified in greater detail here and which extend substantially perpendicularly to the longitudinal centre line M. Those notches serve to decrease the wall thickness and thus to reduce the return capability (return force) of the tongue portions.

Adjoining the second region 10*d* in the direction of the right-hand end 10*b* of the holding part 10 is the third region 10*e* of its outside contour. That third region 10*e* is once again of a frustoconical configuration, wherein the diameter of the truncated cone decreases from the transition from the second region 10*d* to the third region 10*e* towards the right-hand end 10*b*. Disposed in that third region 10*e* or in the corresponding portion of the cavity 12 is a part of the rotary mechanism 40, as will be described in greater detail hereinafter. Provided immediately adjacent to the right-hand 10*b* of the holding part 10 in the interior of the third region 10*e* is an internally screwthreaded portion 10*g* co-operating with the rotary mechanism 40, as will also be described in greater detail hereinafter.

It is also to be noted that the axial length of the first region 10*c* of the holding part 10 is shorter than the axial length of the second region 10*d* and thus also smaller than the axial length of the second and third regions 10*d*, 10*e* together. It is further to be observed that the axial length of the second region 10*d* is greater than that of the third region 10*e*, while the axial length of the first region 10*c* is greater than that of the third region 10*e*.

A coupling portion 16 extends from the shaft shoulder 10*f* at the outside of the second region 10*d* in the direction of the right-hand end 10*b* of the holding part 10. That coupling portion 16 co-operates with a counterpart coupling portion 26, which is described in greater detail hereinafter, of the rotary part 20, in such a way that the holding part 10 is arranged axially fixedly in the interior of the rotary part 20 but rotatably with respect to the rotary part 20.

The rotary part 20 which is also made from plastic material has an outside contour in the form of an elongate truncated cone. In that configuration the outside diameter of the truncated cone decreases from the left-hand end abutment 20*c* of the rotary part 20 to the right-hand end 20*b* thereof.

In its interior the rotary part 20 has a cavity 22 which is of a circular cross-section with respect to the longitudinal centre line M and in which the holding part 10 is partly accommodated and the rotary mechanism 40 is completely accommodated. From its left-hand end 20*a* the cavity 22 is of a constant inside diameter which, by virtue of four limbs (not identified in greater detail) which extend in the longitudinal direction, to form four intermediate spaces in the interior of the cavity 22, decreases to a smaller but also constant inside diameter. The function of the grooves formed in that way is described hereinafter in connection with the structure of the rotary mechanism.

In the region of the left-hand end 20*a* of the rotary part 20 it is provided with a receiving opening 24 for the holding part 10. The right-hand end 20*b* of the rotary part 20 is by comparison closed. The holding part 10 is inserted with its second and third regions 10*d*, 10*e* in the cavity 22. In that arrangement the inside diameter of the cavity 22 of the rotary part 20 at least approximately corresponds to the outside diameter of the holding part 10 in the second region 10*d* thereof.

At its left-hand end 20*a* the rotary part 20 has a counterpart coupling portion 26 which is in the form of a circular ring and which extends integrally in the direction of the left-hand end 10*a* of the holding part 10 from the end face 20*c* of the rotary part 20 and the outside diameter of which is smaller than the outside diameter of the rotary part 20 in the region of the adjoining frustoconical outside contour. The left-hand end (not identified in greater detail) of the coupling portion 26 bears against the shaft shoulder 10*f* of the holding part 10. In addition the outside diameter of the counterpart coupling portion 26 at least approximately corresponds to the outside diameter of the first region 10*c* of the holding part 10 at the shaft shoulder 10*f*. As can be seen from the drawing therefore the region of the two co-operating coupling portions 16, 26 extends from the exit opening 14 of the holding part 10 by a maximum of ⅓ of the axial length of the holding part 10 on the holding part 10.

In its interior the counterpart coupling portion 26 of the rotary part 20 is provided with counterpart coupling elements (not identified in greater detail) which are in mutual engagement with coupling elements (also not identified in greater detail) of the coupling portion 16 of the holding part 10 so as to be difficult to release by means for example of a latching connection in such a way that the holding part 10 is held rotatably but axially immovably with respect to the rotary part 20, and vice-versa.

The end face 20*c* of the rotary part 20 extends at an angle α relative to the longitudinal centre line M, which is less than 90°. In other words the end face 20*c* extends inclinedly with respect to the longitudinal centre line M. That inclinedly extending end face 20*c* serves for more easily removing the protector member 30, as is described in greater detail hereinafter.

It is also to be noted that the extension or the coupling portion 26 of the rotary part 20 also has on its outside a latching groove (not identified in greater detail) which co-operates with a latching bead (not shown in greater detail) on the protector member 30.

The protector member 30 is fitted on to the first region 10*c* of the holding part 10 and on to the counterpart coupling portion 26 of the rotary part 20. The protector member 30 is also of a frustoconical outside contour, wherein the outside diameter of the outside contour decreases uniformly from the left-hand end 30*a* of the protector member 30 to the right-hand end 30*b*. As can be seen from the Figure the outside diameter of the protector member 30 is identical at its right-hand end 30*b* to the outside diameter at the end face 20*c* of the frustoconical outside contour of the rotary part 20. In addition, the extent of the reduction in diameter of the truncated cone configuration of the protector member 30 is the same as the extent of the reduction in diameter of the rotary part 20 so that, when the protector member 30 is fitted on, the applicator device A is overall in the form of an elongate slender truncated cone which decreases uniformly from its left-hand end to its right-hand end.

As can further be seen from the drawing the end 30*a* of the protector member 30, which, when the protector member 30 is fitted on, faces towards the left-hand end 10*a* of the holding part 10, is closed. In its interior the protector member 30 has a cavity 32 which is also of a frustoconical inside contour which is complementary in opposite relationship to the frustoconical outside contour of the protector member 30. In other words, the inside diameter of the cavity 32 decreases from the right-hand end 30*b* to the left-hand end 30*a* of the protector member 30.

At the end 30*b* of the protector member 30, which faces away from the left-hand end 10*a* of the holding part 10, it is open so that there it has a fitting opening 34, by way of which the protector member 30 can be pushed on to the first region 10*c* of the holding part 10 and the counterpart coupling portion 26 of the rotary part 20. For that purpose the inside diameter of the fitting opening 34 is of such a dimension that it at least approximately corresponds to the outside diameter of the counterpart coupling portion 26.

The protector member 30 is pushed on or fitted on until the right-hand end 30*b* thereof or its end face 30*c* bears against the end face 20*c* of the rotary part 20. The end face 30*c* of the protector member 30 extends at an angle β relative to the longitudinal centre line M, which is also less than 90°. In other words the end face 30*c* extends inclinedly relative to the longitudinal centre line M. The two angles α and β are the same so that the end face 30*c* of the protector member 30 bears against the end face 20*c* of the rotary part 20 in full area contact therewith.

Removal of the protector member 30 is effected in a twist-off operation in such a way that the protector member 30 is turned with respect to the rotary part 20. That means that the end face 30*c* of the protector member 30 slides against the end face 20*c* of the rotary part 20. As a result the protector member 30 can be twisted off the rotary part 20 with the application of only a small amount of force and in reliably guided fashion. After the end face 30*c* has come out of contact with the end face 20*c* of the rotary part 20 the protector member 30 can be removed by a linear movement in parallel relationship with the longitudinal centre line M. The operation of fitting the protector member 30 on is effected in the opposite sequence, that is to say the protector member is pushed on to the holding part 10 and the counterpart coupling portion 26 of the rotary part 20 by a linear movement until its end face 30*c* butts against the end face 20*c* of the rotary part 20. Then the protector member 30 or its end face 30*c* can be brought into a condition of bearing against the end face 20*c* of the rotary part 30 again over the full surface area thereof by a rotary movement in opposite relationship to the rotary movement involved in removal of the protector member. The end face 30*c* of the protector member 30 and the abutment surface 20*c* of the rotary part 20 are of counterpart shape which are complementary.

As can be seen from the drawing the axial length $L_A$ of the applicator equals the axial length $L_S$ of the protector member plus the axial length $L_H$. The axial length $L_S$ of the protector member 30 is shorter than the remaining axial length $L_H$ In addition the axial length $L_H$ is shorter than the axial length of the rotary part 20. It is also to be noted that in its interior the protector member 30 has a latching bead (not identified in greater detail) which is in engagement with the latching groove, already referred to hereinbefore, of the counterpart coupling portion 26.

As already mentioned, disposed in the cavity 22 of the rotary part 20 is the rotary mechanism 40, the parts of which are also made from plastic material. It includes a screwthreaded spindle 42 which, at its end 42*b* facing towards the closed end 20*b* of the rotary part 20, has four guide projections 44 of which only two are visible. Those guide projections 44 which are arranged at an angle of 180° relative to each other in the peripheral direction of the spindle 42 each engage into a respective intermediate space (not identified in greater detail) which extends in the longitudinal direction of the rotary part 20 and which is arranged at the inside of the cavity 22 of the rotary part 20. That ensures that, upon a rotary movement of the rotary part 20 with respect to the holding part 10 and vice-versa, the screwthreaded spindle 42 does not also rotate relative to the rotary part 20. At its opposite end 42*a* the screwthreaded spindle 42 is connected by way of a ball joint 46 to a holder 48 which faces in the direction of the left-hand end 10*a* of the holding part 10 and which partially engages over the lead material KM. The holder 48 is of an inside diameter corresponding to the outside diameter of the lead material KM. Preferably the lead material KM is inserted into the holder 48. Furthermore the outside diameter of the holder 48 at least approximately corresponds to the inside diameter of the second region 10*d* of the holding part 10.

At the end 48*a* facing towards the screwthreaded spindle 42 the holder 48 has a ball socket (not identified in greater detail) which is in engagement with a counterpart ball (which is at any event not identified in greater detail) of the screwthreaded spindle 42. That arrangement provides that the rotary movement of the screwthreaded spindle 42 is transposed to the holder 48 in such a way that the holder 48 does not also rotate upon a rotary movement of the screwthreaded spindle 42, but is displaceable together with the screwthreaded spindle 42 in its axial length. In that way the lead material KM can be pushed out of the holding part 10. In particular the screwthreaded spindle 42 is in screwthreaded engagement with the internally screwthreaded portion 10*g* of the holding part 10. Upon a rotary movement preferably of the rotary part 20 the screwthreaded spindle 42 is also caused to rotate by way of its two guide projections 44. By virtue of the screwthreaded engagement with the internally screwthreaded portion 10*g* at the holding part 10 which is held stationary, the screwthreaded spindle 42 is thereby displaced in the direction of the left-hand end 10*a* of the holding part 10 and thus in the direction of the exit opening 12 of the holding part 10. That arrangement provides that, when the lead material KM projecting from the holding part 10 is used up, further lead material KM can be further pushed out.

As can also be seen from the drawing the counterpart coupling portion 26 of the rotary part 20 and the coupling portion 16 of the holding part are arranged close to the exit opening 14 of the holding part 10. In that case the ratio of the overall length $L_A$ of the applicator device A to the length $L_S$ of the protector member 30 can be in a range between 2.5 and 5.5, preferably in a range between 3 and 4.2 and particularly preferably in a range between 3.3 and 3.7. Furthermore the ratio of the length $L_S$ of the protector member 30 to its diameter can be in a range of between 2.5 and 5.5, preferably in a range between 3 and 4.2 and particularly preferably in a range between 3.3 and 3.7.

In contrast to the above-depicted state of the art the present arrangement provides that the protector member 30 is only of a comparatively short axial length, which avoids a tilting action upon removal and fitment of the protector member 30, with the detrimental consequences linked thereto. Furthermore the inclined end faces 20*c*, 30*c* of the rotary part 20 and the protector member 30 provide that first release of the protector member 30 when opening the applicator device A takes place simply and easily, even with creamy hands.

Also, the fact that the applicator device is in the form of a truncated cone with corresponding accumulations of material as well as the long overlap of the holding part 10 by the rotary part 20 provide that the centre of gravity, even when the protector member 30 is removed, is in a region which extends from the exit opening 14 of the holding part 10 to less than half the overall length $L_A$ of the applicator device A.

The invention claimed is:

1. An applicator device for applying a cosmetic material in the form of a lead, comprising a holding part having an axial length, an interior, and an exit opening (10), the interior is adapted to receive a lead material (KM), a rotary part (20) into which the holding part (10) is fitted and which is axially fixedly but rotatably connected to the holding part (10) at a coupling portion (16) thereof by way of a counterpart coupling portion (26) provided on the rotary part (20), a rotary mechanism (40) for axial displacement of the lead material (KM), arranged in the rotary part, and a protector member (30) for covering the exit opening (14), wherein the protector member (30) has a fitting opening (34) at one end (30*b*) and is closed at its other end (30*a*) and wherein the protector member (30) can be reversibly fitted on to the rotary part (20), wherein the axially fixed, rotatable connection between the coupling portion (16) of the holding part (10) and the counterpart coupling portion (26) of the rotary part (20) is formed in a region which extends from the exit opening (14) of the holding part (10) a maximum of ⅓ of the axial length of the holding part (10) on the holding part (10), wherein the rotary part (20) has an axial length and the axial length of the holding part (10) is shorter than the axial length of the rotary part (20).

2. An applicator device according to claim 1, wherein the protector member has an axial length and the axial length of the protector member (30) is shorter than the axial length of the holding part (10).

3. An applicator device according to claim 2, wherein the axial length of the protector member (30) is shorter than the axial length of the rotary part (20).

4. An applicator device according to claim 3, wherein the ratio of the length ($L_A$) of the applicator device (A) to the length ($L_s$) of the protector member (30) is in a range of between 2.5 and 5.5.

5. An applicator device according to claim 3, wherein the ratio of the length ($L_A$) of the applicator device (A) to the length ($L_s$) of the protector member (30) is in a range of between 3 and 4.2.

6. An applicator device according to claim 3, wherein the ratio of the length ($L_A$) of the applicator device (A) to the length ($L_s$) of the protector member (30) is in a range of between 3.3 and 3.7.

7. An applicator device according to claim 3, wherein the ratio of the length ($L_s$) of the protector member to its diameter (DS) is in a range of between 2.5 and 5.5.

8. An applicator device according to claim 3, wherein the ratio of the length ($L_s$) of the protector member to its diameter (DS) is in a range of between 3 and 4.2.

9. An applicator device according to claim 3, wherein the ratio of the length ($L_s$) of the protector member to its diameter (DS) is in a range of between 3.3 and 3.7.

10. An applicator device according to claim 1, wherein the centre of gravity ($X_s$) of the applicator device (A) is in a region which extends from the exit opening (14) of the holding part (10) to less than half the overall length ($L_A$) of the applicator device (A).

11. An applicator device according to claim 1, wherein when the protector member (30) is removed, the centre of gravity ($X_s$) of the applicator device (A) is at least approximately at the centre of the longitudinal extent of the applicator device (A).

12. An applicator device according to claim 1, wherein when the protector member (30) fitted on the applicator device is at least approximately in the shape of a truncated cone whose diameter decreases at least in portion-wise manner from the closed end of the protector member (30) to an opposite end of the rotary part (20).

13. An applicator device according to claim 1, wherein an end face of the protector member (30) at its fitting opening (34) extends at an angle $\beta<90°$ relative to the longitudinal centre line (M) of the applicator device (A).

14. An applicator device according to claim 13, wherein provided on the rotary part (20) is an abutment surface (20*c*) against which the protector member (30) bears in the fitted-on condition and extends at an angle $\alpha<90°$ relative to the longitudinal centre line (M) of the applicator device (A).

15. An applicator device according to claim 14, wherein the angle $\alpha$ is equal to the angle $\beta$.

16. An applicator device according to claim 14, wherein the end face (30*c*) of the protector member (30) and the abutment surface (20*c*) of the rotary part (20) are of counterpart shape which are complementary.

* * * * *